United States Patent [19]

Rowden

[11] 4,188,361

[45] Feb. 12, 1980

[54] RECOVERY OF URANIUM VALUES

[75] Inventor: George A. Rowden, Stockton-on-Tees, England

[73] Assignee: Davy International (Oil and Chemicals) Limited, England

[21] Appl. No.: 895,721

[22] Filed: Apr. 12, 1978

[51] Int. Cl.[2] ..... B01D 11/04

[52] U.S. Cl. ..... 423/9; 422/256

[58] Field of Search ..... 423/9; 23/267 R, 271 R, 23/269, 267 B, 267 MS

[56] References Cited

U.S. PATENT DOCUMENTS

| | | | |
|---|---|---|---|
| 2,877,250 | 3/1959 | Brown et al. | 423/9 |
| 3,052,513 | 9/1962 | Crouse | 423/9 |
| 3,089,750 | 5/1963 | Samuelson et al. | 423/9 |
| 3,223,476 | 12/1965 | Hart | 423/9 |
| 3,335,095 | 8/1967 | Moore | 423/9 |
| 3,341,305 | 9/1967 | Kreevoy et al. | 423/9 |
| 3,359,078 | 12/1967 | Alter et al. | 423/9 X |
| 3,558,288 | 1/1971 | Burrows | 423/9 X |
| 3,787,553 | 1/1974 | Espie et al. | 423/9 |
| 3,857,919 | 12/1974 | Hazen | 423/9 |
| 3,933,971 | 1/1976 | Baucom | 423/9 X |
| 3,966,872 | 6/1976 | Sundar et al. | 423/9 |
| 3,981,961 | 9/1976 | Bathellier et al. | 423/9 |

FOREIGN PATENT DOCUMENTS

| | | | |
|---|---|---|---|
| 1117385 | 6/1968 | United Kingdom | 423/7 |

*Primary Examiner*—Richard E. Schafer
*Attorney, Agent, or Firm*—Bernard & Brown

[57] ABSTRACT

A process and apparatus are described for stripping uranium values from a uranium-loaded organic extractant phase containing, usually, a tertiary amine capable of forming organic-soluble uranium complexes. The sulphate-containing aqueous strip liquor is fed in co-current with the extractant phase to be stripped through a number of mixing stages in series connected one to another without intermediate settling stages and finally to a final settling stage. A "primary" dispersion is maintained in each mixing stage and controlled stepwise pH adjustment of the mixing stages is effected by metered addition of a base, such as ammonia.

10 Claims, 4 Drawing Figures

(a) ALAMINE 336, pH 3·1-3·3

(b) ALAMINE 336, pH 3·5-3·7

(c) ALAMINE 336, pH 3·9-4·0

(d) ALAMINE 336, pH 4·2-4·3

CONCENTRATION OF URANIUM IN 1-1·5M AMMONIUM SULPHATE VERSUS pH (8 HRS. AFTER RAISING pH FROM -4·0 WITH AMMONIA)

RECOVERY OF URANIUM VALUES

This invention relates to the recovery of uranium values, more particularly to the stripping of uranium from uranium-loaded organic extractant media.

Uranium is found in ores such as pitchblende, which is a complicated silicate containing uranium, lead, thorium, iron, clacium, radium, bismuth, antimony and zinc. Other uranium ores include kasolite, which is essentially a lead uranyl silicate, and carnotite $K_2O.2UO_3.V_2O_5.3H_2O$. A common method of extraction of uranium from its ores involves, as an initial step, dissolution in a suitable medium, e.g. sulphuric acid. Separation from other metals present can be achieved by ion exchange followed by elution and liquid-liquid extraction of the eluate. This process is sometimes known as the Bufflex process or Eluex process. Alternatively, depending on the nature of the ore, the initial extract can be submitted to liquid-liquid extraction without such an intermediate ion exchange step. This technique is often referred to as the Purlex process or the Amex process.

Descriptions of the Bufflex, Eluex, Amex and Purlex processes have appeared in the literature. Examples of papers describing these processes are:

1. "Controlled pH Stripping of Uranium from Amines", by D. J. Crouse, ORNL-2941, issued by Oak Ridge National Laboratory, 15th June 1960;
2. "The Production of High-Purity Uranium at a South African Gold Mine", by Dr. A. Faure and co-authors, Journal of the South African Institute of Mining and Metallurgy, March 1966, pages 319 to 341;
3. "Solvent Extraction Processing of Uranium and Thorium Ores", by K. B. Brown, C. F. Coleman, D. J. Crouse, C. A. Blake and A. D. Ryon, United Nations Conference on Peaceful Uses of Atomic Energy, Proceedings of the 2nd International Conference, Geneva, September 1958, Volume 3, pages 472 to 487;
4. "Uranium Recovery by Liquid-Liquid Extraction in South Africa", by A. Faure and T. H. Tunley, IAEA-SM-135/30, pages 241 to 251;
5. "Solvent Extraction in the South African Uranium Industry", by P. J. Lloyd, Journal of The South African Institute of Mining and Metallurgy, March 1962, pages 465 to 480.
6. "The Design, Erection and Operation of a Purlex Plant at Buffelsfontein Gold Mining Company, Ltd.", by B. G. Meyburgh, Journal of The South African Institute of Mining and Metallurgy, October 1970, pages 55 to 66; and
7. "The Extractive Metallurgy of Uranium", by Robert C. Merritt (Colorado School of Mines Institute), published 1971, pages 182 to 211 (see particularly pages 197 to 199 and pages 209 to 211).

In the liquid-liquid extraction technique used in the Eluex, Amex, Bufflex and Purlex processes the uranium-loaded aqueous medium is intimately contacted with an organic medium, such as a kerosene/isodecanol mixture or an aromatic hydrocarbon, containing an organic amine capable of forming organic-soluble complexes with the dissolved uranium values. The uranium-loaded organic extractant is then stripped under carefully controlled acid pH conditions with a sulphate solution such as ammonium sulphate. Such stripping is sometimes termed "hydrolysis stripping". Finally the pH of the resulting uranium-loaded aqueous strip liquor is adjusted to about 7 with ammonia, whereupon a precipitate of ammonium diuranate (the so-called "yellow cake") is formed and can be filtered off.

In the conventionally adopted procedure the uranium-loaded organic extractant phase is stripped in a number of mixer-settlers, sometimes 2, sometimes 3, but more usually 4, arranged so that the aqueous strip liquor and the uranium-loaded organic extractant pass countercurrently through the array of mixer-settlers. In the early paper by D. J. Crouse (see Paper No. 1 referred to above), an arrangement of this kind is illustrated in FIG. 3.1 on page 11 which shows countercurrent stripping in 3 stages with addition of ammonia solution between stages 1 and 2. A similar process was proposed by P. J. Lloyd (see the variant "Hydrolysis Strip "A"" of FIG. 3 on page 473 of Paper No. 5 above) with ammonia addition to the first only of 3 mixer-settlers. Later authors described procedures in which the pH is varied from one stripping stage to the next: see, for example, A. Faure and co-authors, Paper No. 2 above, FIG. 2 on page 323. A later and more detailed flowsheet involving 4 stripping stages, each formed by a mixer-settler combination, with countercurrent flow of the phases between stages and with metered addition of ammonia to all strip mixers to effect a gradual stagewise pH increment from 3.8 in the first mixer to 5.5 in the last mixer, is illustrated in FIG. 1 on page 56 of the afore-mentioned paper by B. G. Meyburgh (Paper No. 6 above).

A disadvantage of these conventional procedures is that each stripping stage requires a corresponding settling tank in order that the "primary" dispersion formed in the corresponding mixer can disengage. Such settling tanks must, in cold climates, be housed in buildings. Furthermore the inventory of organic extractant phase must include a sufficient volume to permit operation of all the settling tanks of the different stages. An indication of the capital cost of the buildings and of the chemicals inventory as a proportion of the total capital cost of a typical uranium solvent extraction plant can be gained from Table X on page 477 of the paper by P. J. Lloyd (Paper No. 5 above). Also, because the settling tanks may be large, correspondingly large amounts of valuable uranium may be held up in each stripping stage. Moreover, each settling tank requires a considerable horizontal area to permit disengagement of commercial rates of flow of dispersion from each mixer box. If, as is usually the case, the organic solvent of the extractant is lighter than water and is also flammable, such as kerosene, then large settling tanks mean that the risk of fire is considerable. The cost of installing appropriate ring mains and other fire-prevention equipment may be substantial.

It is accordingly an object of the present invention to minimise the size of the buildings needed to house the stripping section of a uranium liquid-liquid extraction plant, and hence substantially to reduce the capital cost associated therewith compared with that of the stripping section of a conventional plant.

It is a further object of the invention to reduce substantially the organic inventory of the stripping section of a uranium liquid-liquid extraction plant compared with the inventory of the corresponding stripping section of a conventional plant.

It is a still further object of the invention to reduce the hold up of uranium in the stripping section of a uranium extraction plant.

Yet again, the invention seeks to reduce the horizontal settling area of the stripping section of a uranium liquid-liquid extraction plant, and hence to reduce the fire hazard associated therewith, compared with conventional plants.

It is yet another object of the invention to minimise the capital cost of fire-fighting and fire prevention equipment required for installation at the stripping section of a uranium plant compared with conventional plants.

These and other objects will be apparent to the skilled reader upon further consideration of the following detailed description of the invention.

According to the present invention there is provided a process for the recovery of uranium values from a uranium-loaded organic extractant phase containing an amine capable of forming a uranium-containing complex soluble in the organic extractant phase, which process comprises contacting the extractant phase in a plurality of mixing stages with an acidic aqueous stripping phase containing sulphate ions dissolved therein, the plurality of mixing stages including a first mixing stage and a final mixing stage, passing the phases in co-current through the mixing stages in turn from one mixing stage to the next, agitating the phases in each mixing stage so as to maintain therein a dispersion of droplets of one phase dispersed in the other, the droplets being of a size such that upon standing the dispersion disengages substantially completely under gravity into two separate layers, passing dispersion from the final mixing stage to a final settling stage to permit disengagement of the phases, maintaining the pH in the first mixing stage at a first predetermined value permitting stripping of uranium values from the extractant phase, maintaining the pH in the, or in at least one, subsequent mixing stage at a value greater than the first predetermined value but less than that at which precipitation of uranium values occurs, and recovering disengaged phases from the final settling stage. In this process it may be desirable to recycle at least a part of one of the disengaged phases from the final settling stage to one of the mixing stages in order to maintain a desirable volume ratio of the phases in one or more of the mixing stages despite a different feed rate ratio of the phases by volume to the process. Conveniently such recycled disengaged phase is recycled to the first mixing stage. It is preferred that in each of the mixing stages the volume ratio of the phases lies between about 5:1 and about 1:5, more preferably in the range of from about 2:1 to about 1:2, e.g. about 1:1. The feed rate ratio of the phases to the process may vary within wide limits, e.g. for about 20:1 to about 1:20, more usually in the range of from about 10:1 to about 1:10, e.g. about 5:1 to about 1:5. Usually the organic extractant phase will be fed in excess of the fresh aqueous stripping phase.

In each of the mixing stages there is formed a dispersion of which the droplets of dispersed phase are capable of settling out substantially completely into two layers upon standing under gravity. Such dispersions can be termed "primary" dispersions and have droplet sizes of dispersed phase usually larger than about 100 microns in diameter. "Secondary" dispersion-sized droplets, which have diameters usually of less than about 20 microns, are to be avoided since such "secondary" dispersions do not separate under gravity into two layers upon standing.

The amine used in the process of the invention may be any amine known to be suitable for uranium liquid-liquid extraction. Thus it may be a secondary amine, more particularly a highly branched secondary amine. Typical secondary amines used for liquid-liquid extraction of uranium include "Amine S-24", "Amberlite LA-1" and "Amberlite LA-2". Suitable secondary amines can be obtained from Union Carbide Corporation and from Rohm and Haas Company. It is preferred, however, to use a tertiary amine, more specifically usually a long chain aliphatic tertiary amine. As tertiary amines that may be used there may be mentioned tri-n-octylamine, tri-iso-octylamine, tri-laurylamine, tri-caprylamine, tris-(tridecyl)-amine, butyl-dilaurylamine and the like. Mixtures of two or more amines may be used. Commercially available tertiary amines suitable for the purposes of the invention include "Alamine 336", "Alamine 304" and "Adogen 364", as well as tri-iso-octylamine. Such commercial tertiary amines can be obtained from such commercial sources as Union Carbide Corporation, General Mills and Ashland Chemical Company.

The amine component may comprise up to 10% by volume of the organic extractant phase, more particularly from about 1% to about 8% by volume, e.g. about 5% by volume, thereof.

The organic extractant phase may comprise up to 90% by volume or more of an inert ingredient whose principal function is to act as a carrier or diluent. Kerosene is the usual diluent in uranium processing due to its low cost and high flash point, although other organic solvents such as toluene, carbon tetrachloride, fuel oil, or other petroleum derivatives may be used. The free base forms of most of the amines are compatible with kerosene but some of the amine salts show limited solubility. In order to prevent separation of the amine sulphate it is conventional practice to incorporate in the organic extractant phase a minor amount, conveniently up to about 10% by volume, but usually not more than 5% by volume of a long-chain aliphatic alcohol such as tridecanol, or isodecanol. The long-chain aliphatic alcohol may be wholly or partially replaced by an aromatic hydrocarbon.

In each of the mixing stages the dispersion may be organic-continuous or aqueous-continuous. It is preferred to operate under aqueous-continuous conditions. However, one or more of the mixing stages may be operated organic-continuous whilst one or more others are operated in an aqueous-continuous mode.

Typically the pH of the first mixing stage is at least about 3.0, e.g. about 3.5. The pH of the, or at least one, subsequent mixing stage is higher than that of the first mixing stage. The pH of any mixing stage should not desirably exceed about 5.5 in order to avoid formation of diuranates and other insoluble uranium compounds.

The process may involve the use of any number of mixing stages, e.g. 2, 3 or more. Hence there may be one or more intermediate mixing stages between the first and final mixing stages. Conveniently there are 4 mixing stages in all.

In a preferred embodiment the invention provides in a process for the extraction of uranium from an ore thereof which comprises the steps of:

extracting an aqueous solution containing uranium values dissolved therein with an organic extractant phase comprising a tertiary amine capable of forming a uranium-containing complex soluble in the organic extractant phase;

stripping resulting uranium-loaded organic extractant phase in a series of stripping stages with an acidic aqueous sulphate-containing stripping liquor with controlled stepwise increase of pH; and recovering uranium from resulting uranium-loaded aqueous stripping liquor, the improvement comprising effecting stripping by a series of steps comprising:

feeding uranium-loaded organic extractant phase and acidic aqueous sulphate-containing stripping liquor at a first pH less than 4.0 to a first mixing stage;

agitating the phases in the first mixing stage so as to form a dispersion of primary-sized dispersion droplets of one phase dispersed in the other, the droplets of the one phase being of a size such that, upon standing under gravity, the dispersion will disengage substantially completely into two layers, removing mixed phases from the first mixing stage;

passing mixed phases in co-current to one or more subsequent mixing stages, including a final mixing stage, connected in series with the first mixing stage, agitating the phases in the or each subsequent mixing stage so as to maintain therein a dispersion of primary-sized dispersion droplets of one phase dispersed in the other, maintaining the, or at least one, subsequent mixing stage at a pH greater than the first pH but less than that at which substantial precipitation of uranium values occurs by controlled addition thereto of a base, passing resulting dispersion from the final mixing stage to a final settling stage, allowing dispersion to disengage in the final settling stage, recovering disengaged phases from the final settling stage consisting of essentially uranium-free organic extractant phase and uranium-loaded aqueous stripping liquor, and recycling at least a portion of one of the disengaged phases to the first mixing stage so as to maintain therein a phase ratio by volume of from about 2:1 to about 1:2.

pH adjustment is conveniently achieved by adding metered amounts of a base, e.g. ammonium hydroxide or anhydrous ammonia to the appropriate mixing stage. It is normally desirable to monitor the pH carefully in each mixing stage and to make any necessary adjustment of the pH by controlled addition of the chosen base. Besides ammonium hydroxide and anhydrous ammonia, there may be mentioned sodium hydroxide, potassium hydroxide, sodium carbonate, sodium bicarbonate, potassium carbonate, potassium bicarbonate, magnesium oxide, magnesium hydroxide, calcium oxide (quicklime) and the like, and mixtures thereof.

The source of dissolved sulphate ions in the aqueous stripping phase may be any water-soluble inorganic sulphate, such as sodium sulphate, magnesium sulphate, sodium hydrogen sulphate, potassium sulphate, potassium hydrogen sulphate, ammonium sulphate or the like. The preferred sulphate in the aqueous stripping phase is ammonium sulphate. It is preferred that the concentration of the source of sulphate ions ranges from about 0.1 M or less up to the solubility limit of the sulphate or of the least soluble sulphate present. Conveniently the concentration lies in the range of about 1 M to 2 M.

It is preferred that, where possible the cation of the base is the same as the cation of the source of sulphate ions. Hence, if ammonium hydroxide is the chosen base, the source of sulphate ions is preferably ammonium sulphate, and so on.

The process is preferably operated continuously. It is conveniently operated at temperatures in the range of about 15° C. to about 50° C., e.g. in the range of from about 20° C. to about 40° C.

When there is more than one subsequent mixing stage after the first mixing stage it will usually be preferred to add base at each of the subsequent mixing stages so as to achieve a stepwise increase of pH from one mixing stage to the next. However it is alternatively possible to operate one or more of the subsequent mixing stages at the same pH as that of the preceding mixing stage. Thus where there are 3 mixing stages in all base may be added to the first and second mixing stages only or to the first and third mixing stages only. Where there are four mixing stages in all, for example, base may be added to the first, second and third mixing stages (but not to the fourth and final mixing stage) or to the first, third and fourth mixing stage (and not to the second) and so on.

In all cases it is preferable to add base to the relevant mixing stage at a zone of intense mixing to prevent inadvertent increase of pH above the relevant desired value.

The residence time in each mixing stage preferably lies in the range of from about 1 minute to about 10 minutes, e.g. from about 2 to about 8 minutes.

The invention further provides apparatus for effecting recovery of uranium values from a uranium-loaded organic extractant phase containing an amine capable of forming a uranium-containing complex soluble in the organic extractant phase, which apparatus comprises a first mixing chamber, a final mixing chamber, a final settling chamber for receipt of dispersion from the final mixing chamber, means for feeding to the first mixing chamber the extractant phase and an acidic aqueous stripping phase containing sulphate ions dissolved therein, means connecting the mixing chambers in series whereby the phases may flow in co-current through the mixing chambers in turn, mixing means in each mixing chamber for agitating the phases so as to maintain therein a dispersion of droplets of one phase dispersed in the other, the droplets being of a size such that the dispersion settles upon standing under gravity substantially completely into two separate layers, means for controlling the pH in the mixing chambers so as to permit maintenance in the first mixing chamber of a pH having a first predetermined value permitting recovery of uranium values from the organic extractant phase by the aqueous stripping phase and in the, or in at least one, subsequent mixing chamber of a pH greater than the first predetermined value but less than that at which precipitation of uranium values occurs, and means for recovering disengaged phases from the final settling chamber.

It will be seen that, since the invention requires the presence of only a single settling stage, i.e. the final settling stage, the construction costs of the associated buildings needed in cold climates is correspondingly reduced compared with a conventional plant. Furthermore, because there need be only a single settling stage, the inventory of extractant can be correspondingly reduced, and the fire hazard can equally be reduced, compared with a conventional plant which has, for example, four settling stages. Since the phases flow in co-current gravity assisted flow can be used between the various stages if the plant location is suitable and in this case a pump is needed only for the recycle stream, if any. Another consequence of the use of a single settling stage is that the uranium hold up in the plant is greatly reduced.

In order that the invention may be clearly understood and readily carried into effect a preferred embodiment of the apparatus of the invention, and a preferred method of working thereof, will now be described, by way of example only, with reference to the accompanying diagrammatic drawings, wherein.

Figure 1:
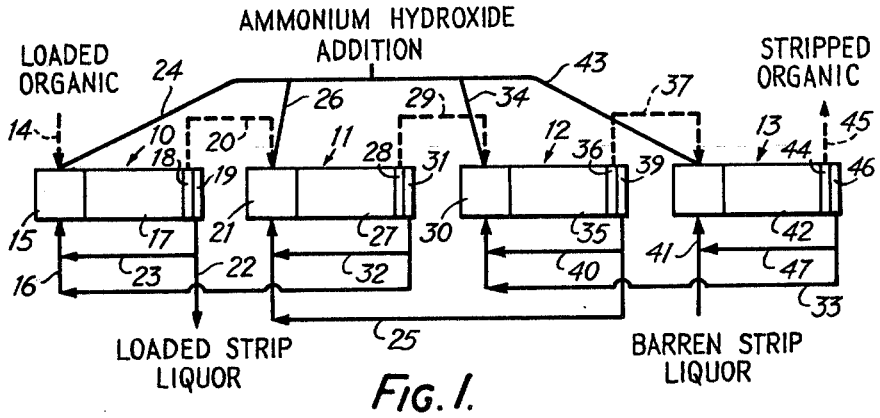
FIG. 1 is a plan view of a conventional stripping section of a uranium liquid-liquid extraction plant.
Figure 4:
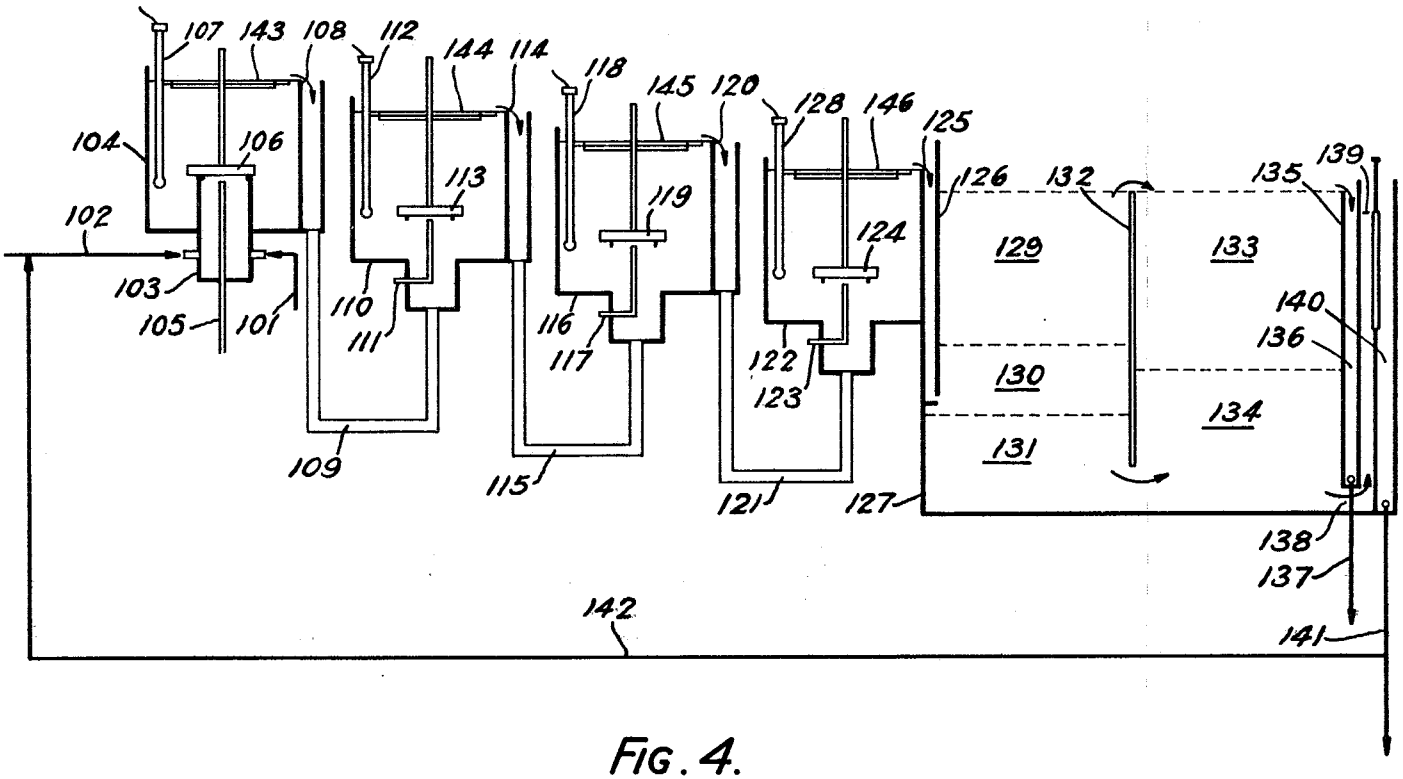
FIG. 4 is a side view of a stripping section, constructed in accordance with the invention, of an experimental uranium liquid-liquid extraction plant.

It will be appreciated by those skilled in the art that, for the sake of simplicity, various items of equipment that would in practice be essential for operation of the stripping sections illustrated in FIGS. 1 and 4 have been omitted from the accompanying drawings. Such items include, for example, pumps, valves, impeller motors, metering devices for adding ammonium hydroxide, control devices, and temperature sensors, and will be incorporated in a practical plant in accordance with standard chemical engineering practice.

The stripping section of FIG. 1 comprises first stage 10, second stage 11, third stage 12 and final stage 13, each consisting of a conventional mixer-settler. The uranium-loaded amine extractant (or "loaded organic" as it is conveniently termed) is supplied via line 14 to mixer box 15 of first stage 10 in which it contacts the aqueous ammonium sulphate-based strip liquor, which is already partially loaded with uranium, from second stage 11. This partially loaded strip liquor is supplied via line 16. The two phases are mixed in mixer box 15 by means of an impeller (not shown) and the resulting "primary dispersion" is allowed to pass into settling tank 17 of first stage 10. The disengaged organic and aqueous phases are collected from settling tank 17 by means of the usual overflow and underflow arrangements in launders 18 and 19 respectively. Disengaged organic phase, now partially stripped of uranium values, passes on from launder 18 via line 20 to mixer box 21 of second stage 11. A part of the loaded aqueous strip liquor is removed from launder 19 via line 22 whilst a part is recycled to mixer box 15 via line 23.

Typically the organic extractant phase comprises a kerosene/isodecanol solution (containing up to, for example, about 10% by weight of isodecanol) of 5% by volume of an amine capable of forming a kerosene-soluble complex with uranium values, such as the material sold under the trade name "Alamine 336". The pH of the aqueous phase is maintained at 3.5 in first stage 10 by metered addition to mixer box 15 of ammonium hydroxide solution via line 24. (pH electrodes are not shown in FIG. 1).

The stripping reaction can be represented as follows:

$$\underset{\text{org.}}{(R_3NH)_2UO_2(SO_4)_2} + \underset{\text{aq.}}{2NH_3} \longrightarrow \underset{\text{org.}}{2R_3N} + \underset{\text{aq.}}{(NH_4)_2SO_4} + \underset{\text{aq.}}{UO_2SO_4}$$

where R is an organic residue such that $R_3N$ is a hydrophobic, kerosene-soluble amine capable of complexing with uranium values to form the above-represented organic phase-soluble complex.

In mixer box 21 the partially uranium-depleted organic phase is mixed by means of an impeller (not shown) with partially loaded aqueous phase from third stage 12 which is supplied via line 25. The pH in second stage 11 is maintained at 4.0 by metering in ammonium hydroxide solution via line 26. Dispersion formed in mixer box 21 passes into settling tank 27. Disengaged organic phase is collected in launder 28 and passed via line 29 to mixer box 30 of third stage 12. A part of the disengaged aqueous phase is passed from launder 31 via line 16 to first stage 10 while a part is recycled to mixer box 21 via line 32.

In mixer box 30 the organic phase from second stage 11 is contacted with aqueous strip liquor, already partially loaded with uranium, from final stage 13 supplied by line 33. The pH of the aqueous phase in third stage 12 is maintained at 4.5 by addition of ammonium hydroxide via line 34 to mixer box 30. Dispersion is formed by means of an impeller (not shown) in mixer box 30 and passes to settling tank 35. Disengaged organic phase is collected in launder 36 and is passed via line 37 to mixer box 38 of final stage 13. Disengaged aqueous phase is collected in launder 39, a part being passed to second stage 11 via line 25 while the remainder is recycled to mixer box 30 via line 40.

In final stage 13 1M ammonium sulphate is fed to mixer box 38 via line 41. Dispersion formed in mixer box 38 by means of an impeller (not shown) passes to settling tank 42 for disengagement of the phases. The pH of the aqueous phase is maintained at a value in the range of 4.5–5.0 by addition of ammonium hydroxide via line 43 to mixer box 38. Stripped organic phase, now substantially uranium-free, collects in launder 44 and is removed via line 45. Disengaged aqueous phase collects in launder 46 from which it is removed via line 33, part being passed to third stage 12 via line 33 and part being recycled to mixer box 38 via line 47.

In each of the stages 10, 11, 12, 13, 14 aqueous phase is recycled from the corresponding settling tank in order to maintain a favourable phase ratio, e.g. 1:1 by volume, in the mixer box despite a different feed rate ratio, e.g. 5:1 organic:aqueous by volume, to the stripping section via lines 14 and 41 respectively.

The loaded aqueous strip liquor removed via line 22 is further worked up in order to recover the dissolved uranium values, for example by adding further ammonium hydroxide to adjust the pH to about 7 so as to cause precipitation of "yellow cake" (ammonium diuranate), according to the following reaction:

$$2UO_2SO_4 + 6NH_3 + 3H_2O \rightarrow (NH_4)_2U_2O_7 \downarrow + 2(NH_4)_2SO_4$$

The stripped organic liquor in line 45 is passed, either directly or via an appropriate "regeneration" section, to an "extraction" section for extraction of further uranium values from an aqueous feed solution thereof.

Figure 2:
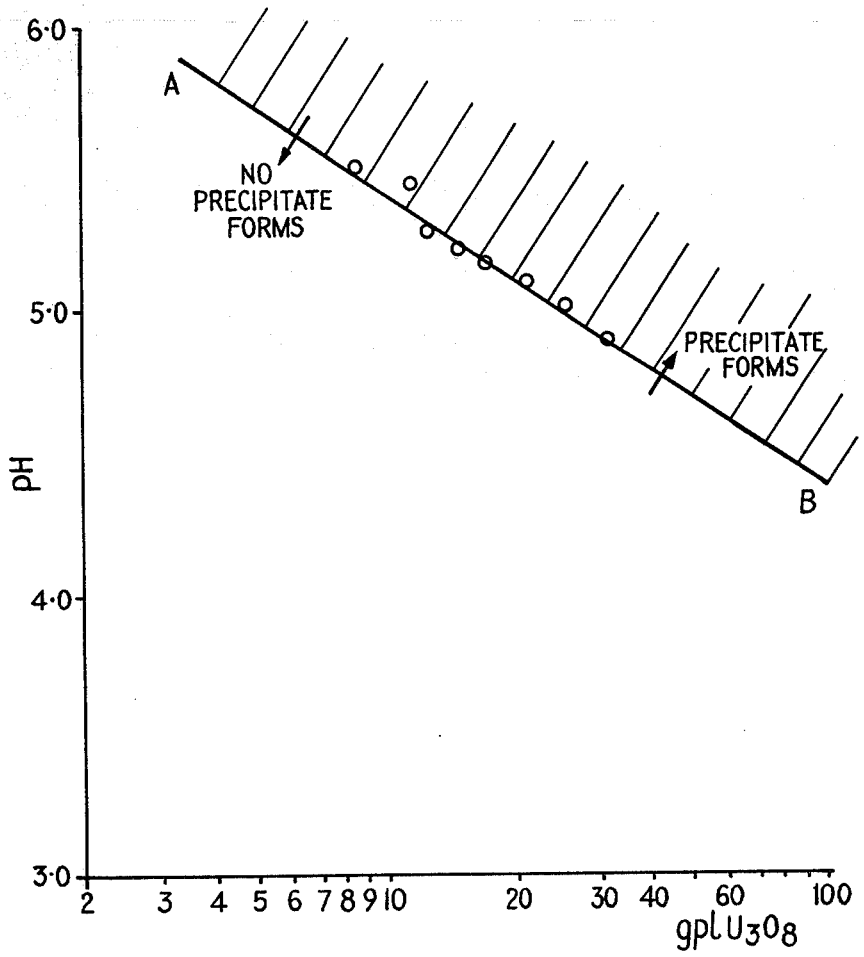
FIG. 2 is a graph illustrating formation of a precipitate of ammonium diuranate from an ammonium sulphate solution (1–1.5M) at different pH's and at different concentrations of uranium values.

FIG. 2 illustrates the relationship between pH, precipitation of "yellow cake" and uranium concentration calculated as $U_3O_8$. Experiments have shown that in 1–1.5M ammonium sulphate solution "yellow cake" is precipitated at the pH indicated by the line A-B if the pH at a particular uranium concentration is increased from 4.0 by addition of ammonia. In both the conventional process and the process of the invention care must accordingly be taken that in each stripping stage the pH is so matched to the aqueous uranium concentration as to lie under the line A-B of FIG. 2 (and not in the shaded area above the line) in order to avoid "crud" formation.

Figure 3:
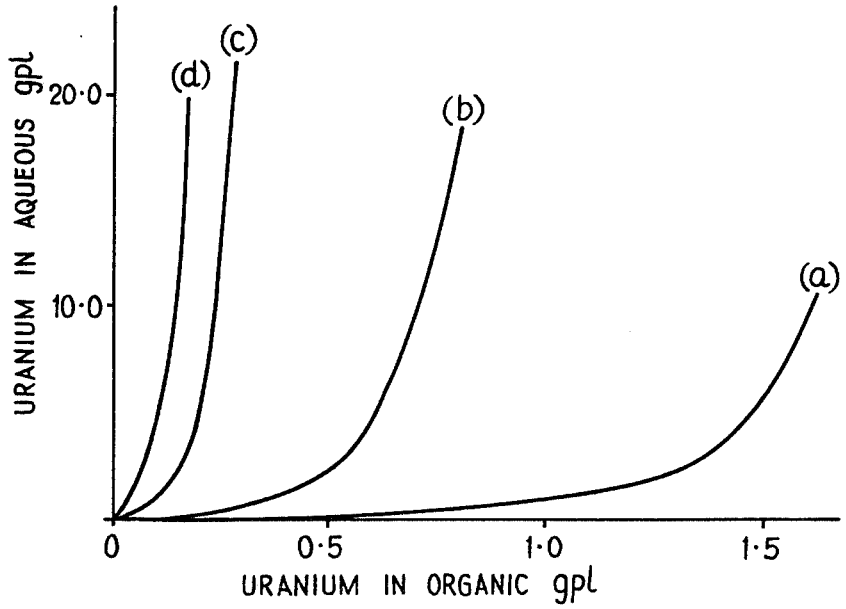
FIG. 3 is a diagram showing uranium stripping isotherms at various pH values.

FIG. 3 illustrates the relationship between the concentrations of uranium in equilibriated organic and aqueous phases at different pH values using Alamine 336 in kerosene. Line (a) shows the relationship at pH 3.1–3.3, line (b) at pH 3.5–3.7, line (c) at pH 3.9–4.0 and line (d) at pH 4.2–4.3. This data is taken from the paper "Controlled pH Stripping of Uranium from Amines" by D. J. Crouse, ORNL-2941, June 15, 1960. This graph shows that best results are obtained as the pH increases.

The stripping section of an experimental uranium liquid-liquid extraction plant constructed according to the invention is illustrated in FIG. 4. Loaded organic phase, e.g. uranium-loaded 5% by volume "Alamine 336" in kerosene/2.5% by volume isodecanol, is supplied via line 101, whilst 1M ammonium sulphate solution is supplied via line 102, to draught tube 103 of first mixer box 104, whose capacity is approximately 1 liter. The pH is maintained at 3.0 by addition of metered amounts of aqueous ammonium hydroxide solution via line 105. A "primary" dispersion is formed in mixer box 104 by means of impeller 106. pH is monitored by means of pH electrode 107. Dispersion from mixer box 104 overflows weir 108 and passes via line 109 to second mixer box 110, also of 1 liter capacity. Further ammonium hydroxide is metered into second mixer box 110 via line 111 in order to maintain the pH in second mixer box 110 at 4.0. pH monitoring is achieved by means of pH electrode 112. Mixer box 110 contains a further impeller 113 which serves to maintain the phases dispersed one in another in "primary" dispersion-sized droplets. Dispersion from mixer box 110 overflows weir 114 and passes via line 115 to third mixer box 116 (also of 1 liter capacity), the pH in which is kept at pH 4.5 by adding further aqueous ammonium hydroxide solution via line 117. Monitoring of pH is achieved by means of pH electrode 118. The phases are re-dispersed or maintained in dispersion one within the other in third mixer box 116 by means of a further impeller 119. "Primary" dispersion then overflows weir 120 and passes via line 121 to mixer box 122 of the fourth and final mixing stage. pH control at 4.5–5.0 is effected by adding further ammonium hydroxide solution via line 123. A further impeller 124 ensures redispersion or maintenance of the phases as a "primary" dispersion which is then passed over weir 125 and under an adjustable introductory baffle 126 into settling tank 127. The pH in mixer box 122 is monitored by means of pH electrode 128. The capacity of mixer box 122 is also approximately 1 liter. Three bands are formed in settling tank 127, namely an upper layer 129 of disengaged organic phase, a middle band 130 of dispersion, and a lower layer 131 of disengaged aqueous phase. Reference numeral 132 indicates a dam baffle which prevents dispersion flowing into the downstream section of settling tank 127. Downstream from dam baffle 132 there are thus two layers of liquid only, an upper layer 133 of disengaged organic phase and a lower layer 134 of disengaged aqueous phase. By means of a conventional overflow weir 135 disengaged stripped organic phase, now essentially uranium-free, is collected from layer 133 in launder 136 for removal via line 137. Disengaged aqueous uranium-loaded strip liquor from layer 134 passes through underflow passage 138 and then over adjustable weir 139 and is then collected in launder 140. Part of the strip liquor is removed via line 141 for further treatment, e.g. pH adjustment to about 7 by addition of more ammonium hydroxide in order to precipitate "yellow cake", whilst the remainder is recycled via line 142 to first mixer box 104. In this way a favourable volume ratio of the phases in the range of, for example, 2:1 to 1:2, can be maintained in the mixer boxes 104, 110, 116, 122 despite a different feed ratio of the phases via lines 101 and 102, for example, an organic to aqueous feed ratio of 3:1 by volume.

In FIG. 4, reference numerals 143, 144, 145, 146 indicate respective top baffles intended to prevent air entrainment and to break any vortex in the corresponding mixer box. As can be seen the ammonia is added via lines 105, 111, 117, 123 into the "eye" of the respective impeller so as to ensure efficient admixture thereof into the dispersion and to avoid any localised increase of pH beyond the intended value.

As with the apparatus of FIG. 1, the pH conditions must be matched to the uranium concentration in each stage so as to keep the overall conditions below line A-B of FIG. 2 and hence avoid formation of ammonium diuranate.

In the apparatus of FIG. 1, the fresh uranium-loaded organic liquor fed through line 14 contacts already partially loaded aqueous strip liquor in the first mixer-settler 10. In the second mixer-settler 11, the concentrations of uranium in both the organic and aqueous phases are each lower than the corresponding values in the first mixer-settler 10. In mixer-settler 12 they are again lower and are lowest in mixer-settler 13. This results from the countercurrent flow of the phase between the mixer-settlers.

In contrast, with the co-current flow arrangement of FIG. 4, the heavily uranium-loaded organic liquor in line 101 meets barren strip liquor from line 103 in the first mixer 104. As the two phases flow on through the mixers 110, 116 and 122 the organic phase becomes progressively uranium-depleted whilst the aqueous phase becomes increasingly loaded with uranium values.

The invention will be further illustrated with reference to the following Example.

EXAMPLE

In this Example the apparatus illustrated in FIG. 4 was used. A uranium-loaded organic liquor was supplied at a rate of 250 ml per minute via line 101 whilst an aqueous strip liquor was fed at a rate of 83.3 ml per minute via line 102. The organic phase consisted of 5% by volume Alamine 336 in 2.5% by volume isodecanol in Kermac W (a commercial kerosene fraction) containing 6.01 grams per liter of uranium calculated as $U_3O_8$. The aqueous strip liquor was 150 grams per liter ammonium sulphate solution. The pH in mixer box 104 was controlled to be 3.42 by addition of metered quantities of ammonia solution. In mixer box 110 the pH was 3.67, in mixer box 116 it was 4.02 and in mixer box 122 it was 4.31. The temperature was 25° C. In each of the mixers the continuous phase was the aqueous phase. Disengaged aqueous phase was recycled via line 142 at a rate of 166.7 ml per minute. The uranium concentration in the stripped organic phase in line 137 was 0.0023 grams per liter calculated as $U_3O_8$, whilst the uranium concentration in the aqueous phase in line 141 was 12.85 grams per liter calculated as $U_3O_8$. The stripping efficiency was calculated to be 99.96%. The residence time in each mixer box was 2 minutes. Ammonium diuranate can be recovered from the aqueous phase in line 141 by precipitation at about pH 7 with ammonium hydroxide. The phase ratio by volume in each mixer box was 1:1. Ammonia was added to each mixer box as a 5% by volume solution (i.e. 5 vols 0.880 ammonia to 95 vols water).

What is claimed is:

1. A process for the recovery of uranium values from a uranium-loaded organic extractant phase containing an amine capable of forming a uranium-containing complex soluble in the organic extractant phase, which process comprises contacting the extractant phase in a plurality of mixing stages with an acidic aqueous stripping phase containing sulphate ions dissolved therein, the plurality of mixing stages including a first mixing stage and a final mixing stage, passing the phases in co-current through the mixing stages in turn from one mixing stage to the next, agitating the phases in each mixing stage so as to maintain therein a dispersion of droplets of one phase dispersed in the other, the droplets being of a size such that upon standing the dispersion disengages substantially completely under gravity into two separate layers, passing dispersion from the final mixing stage to a final settling stage to permit disengagement of the phases, maintaining the pH in the first mixing stage at a first predetermined value permitting stripping of uranium values from the extractant phase, maintaining the pH in the, or in at least one, subsequent mixing stage at a value greater than the first predetermined value but less than that at which precipitation of uranium values occurs, and recovering disengaged phases from the final settling stage.

2. A process according to claim 1, in which at least a portion of one of the disengaged phases is recycled to the first mixing stage in order to maintain therein a volume ratio of the phases of between about 5:1 and about 1:5.

3. A process according to claim 2, in which the volume ratio in the first mixing stage lies in the range of from about 2:1 to about 1:2.

4. A process according to claim 1, in which the step of maintaining the pH in the, or in at least one, subsequent mixing stage comprises controlled addition of a base and in which the acidic aqueous stripping phase contains an inorganic sulphate whose cation is the same as that of the base.

5. A process according to claim 4, in which the base is ammonia and in which the inorganic sulphate is ammonium sulphate.

6. A process according to claim 1, in which four mixing stages in all are used.

7. A process according to claim 1, in which the dispersion in each of the mixing stages is of the aqueous-continuous type.

8. Apparatus for effecting recovery of uranium values from a uranium-loaded organic extractant phase containing an amine capable of forming a uranium-containing complex soluble in the organic extractant phase, which apparatus comprises a first mixing chamber, a final mixing chamber, a final settling chamber for receipt of dispersion from the final mixing chamber, means for feeding to the first mixing chamber the extractant phase and an acidic aqueous stripping phase containing sulphate ions dissolved therein, means connecting the mixing chambers in series whereby the phases may flow in co-current through the mixing chambers in turn, mixing means in each mixing chamber for agitating the phases so as to maintain therein a dispersion of droplets of one phase dispersed in the other, the droplets being of a size such that the dispersion settles upon standing under gravity substantially completely into two separate layers, means for controlling the pH in the mixing chambers so as to permit maintenance in the first mixing chamber of a pH having a first predetermined value permitting recovery of uranium values from the organic extractant phase by the aqueous stripping phase and in the, or in at least one, subsequent mixing chamber of a pH greater than the first predetermined value but less than that at which precipitation of uranium values occurs, and means for recovering disengaged phases from the final settling chamber.

9. In a process for the extraction of uranium from an ore thereof which comprises the steps of:

extracting an aqueous solution containing uranium values dissolved therein with an organic extractant phase comprising a tertiary amine capable of forming a uranium-containing complex soluble in the organic extractant phase;

stripping resulting uranium-loaded organic extractant phase in a series of stripping stages with an acidic aqueous sulphate-containing stripping liquor with controlled stepwise increase of pH; and recovering uranium from resulting uranium-loaded aqueous stripping liquor, the improvement comprising effecting stripping by a series of steps comprising:

feeding uranium-loaded organic extractant phase and acidic aqueous sulphate-containing stripping liquor at a first pH less than 4.0 to a first mixing stage;

agitating the phases in the first mixing stage so as to form a dispersion of primary-sized dispersion droplets of one phase dispersed in the other, the droplets of the one phase being of a size such that, upon standing under gravity, the dispersion will disengage substantially completely into two layers, removing mixed phases from the first mixing stage;

passing mixed phases in co-current to one or more subsequent mixing stages, including a final mixing stage, connected in series with the first mixing stage, agitating the phases in the or each subsequent mixing stage so as to maintain therein a dispersion of primary-sized dispersion droplets of one phase dispersed in the other, maintaining the, or at least one, subsequent mixing stage at a pH greater than the first pH but less than that at which substantial precipitation of uranium values occurs by controlled addition thereto of a base, passing resulting dispersion from the final mixing stage to a final settling stage, allowing dispersion to disengage in the final settling stage, recovering disengaged phases from the final settling stage consisting of essentially uranium-free organic extractant phase and uranium-loaded aqueous stripping liquor, and recycling at least a portion of one of the disengaged phases to the first mixing stage so as to maintain therein a phase ratio by volume of from about 2:1 to about 1:2.

10. A process according to claim 1, in which the plurality of stages includes at least one intermediate mixing stage between the first and final mixing stages and in which the pH is increased stepwise from each mixing stage to the next mixing stage, the pH in the final mixing stage being less than that at which precipitation of uranium values occurs.

* * * * *